United States Patent [19]

McCauley

[11] Patent Number: 4,832,501

[45] Date of Patent: May 23, 1989

[54] STOVE TOP STIRRER

[76] Inventor: Gayle A. McCauley, 40 Belmont St., Melrose, Mass. 02176

[21] Appl. No.: 184,017

[22] Filed: Apr. 20, 1988

[51] Int. Cl.[4] ..... B01F 7/18

[52] U.S. Cl. ..... 366/279; 99/348; 366/286

[58] Field of Search ..... 99/348; 366/279, 281, 366/282, 283, 284, 285, 286, 244, 245, 247, 249, 251, 252, 254

[56] References Cited

U.S. PATENT DOCUMENTS

| | | | |
|---|---|---|---|
| 3,575 | 5/1844 | Roop . | |
| 723,977 | 3/1903 | Barney | 366/282 |
| 1,193,954 | 8/1916 | Walden . | |
| 3,357,685 | 12/1967 | Stephens | 99/348 |
| 3,697,053 | 10/1972 | Will . | |
| 3,810,605 | 5/1974 | Lambert | 99/348 |
| 4,151,792 | 5/1979 | Nearhood | 99/348 |
| 4,339,992 | 7/1982 | Kurland . | |
| 4,429,624 | 2/1984 | Linn . | |

*Primary Examiner*—Robert W. Jenkins

*Attorney, Agent, or Firm*—Hamilton, Brook, Smith & Reynolds

[57] ABSTRACT

A motorized stirring device is mounted to a container for cooking on top of a stove. Three or more legs each attached at one end to the rim of the container support a motor attached to respective opposite ends. The legs support the motor at a height sufficiently above the plane in which the rim lies and are sufficiently narrow in width with respect to the circumference of the rim such that the container remains substantially uncovered by the legs and motor. Stirring attachments of self-adjusting length are releaseably connected to a shaft driven by the motor and directed toward the container. A middle section of each stirring attachment varies the total length of the stirring attachment by sliding in a telescoping manner.

13 Claims, 4 Drawing Sheets

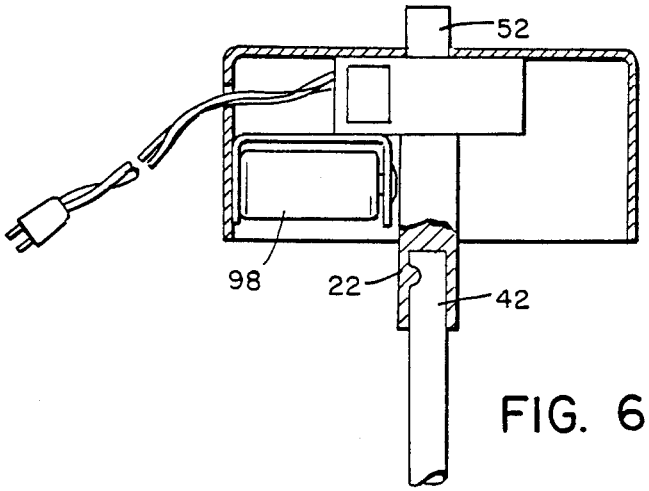
FIG. 6
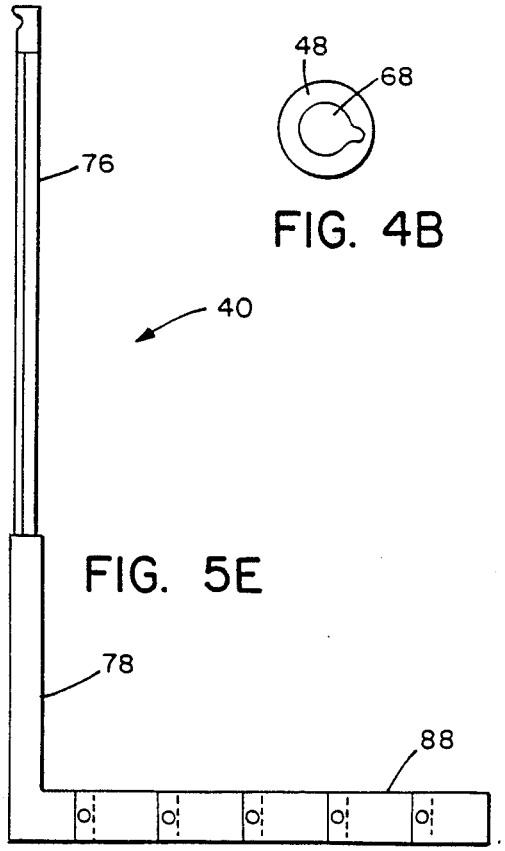
FIG. 5E
FIG. 4B
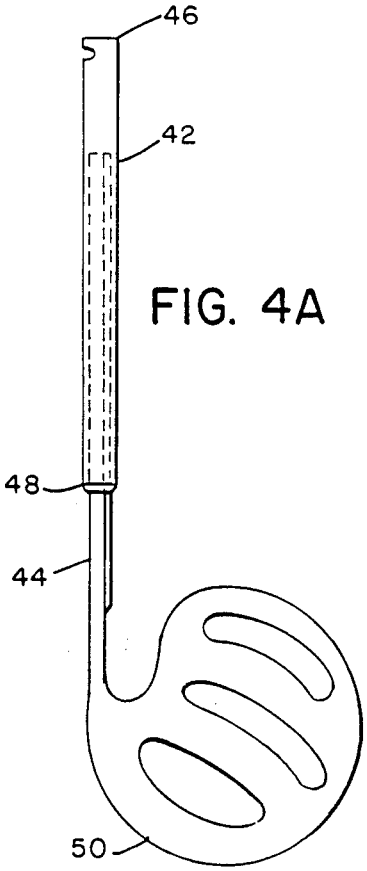
FIG. 4A

ATTACHMENTS:

STOVE TOP STIRRER

BACKGROUND OF THE INVENTION

In the art of cooking, various tools are used for dispersing ingredients in a container. Basic stirring of chopped vegetables, various sauces, spreads and dips is still largely accomplished manually. On the other hand, blenders are effectively used to mix liquid ingredients. Electric mixers are used to combine dry and liquid ingredients or to whip cream for example. However, these automated appliances are generally for saving time in accomplishing desired mixing tasks which do not require some sort of concurrent cooking/heating time, but where stirring, especially periodically, over a length of time is required, very few automated utensils are available.

Stirring the contents of a saucepan over a burner of a stove is one such stirring task which is largely unaided by automated devices, especially slow cooking items in a cooking container. However, in U.S. Pat. No. 4,429,624 to Linn, a stirring device incorporated in the lid and handle of a domestic cooking pot is disclosed. The stirring action is generated by a system of pulleys which expand and contract with a sensed change in temperature.

In U.S. Pat. No. 4,339,992 to Kurland, a motorized stirring device is disclosed. The device is mounted over the top of the cooking container in lieu of a lid, except the device only partially covers the container. The motor is supported by the mounting piece, and a blade suspended from the mounting piece into the container is rotated by the motor.

U.S. Pat. No. 3,697,053 to Will discloses a stirring device having variable speed. The device is mounted inside the cooking container with radially extending arms with contact ends which engage with the inner walls of the cooking container.

SUMMARY OF THE INVENTION

The present invention provides an improvement in stirring devices of the prior art. In particular, the present invention provides a motorized stirring device adapted to be mounted to and stir the contents of a container preferably a domestic container used for cooking on top of a stove.

In one embodiment of the present invention, one end of each of several legs is connected to a motor. Opposite ends of the legs attach to the rim of the container. The width of the legs are thin relative to the amount of space left between each leg about the circumference of the rim. Further, the legs support the motor at a height above the plane in which the rim lies. The thinness of the legs and the height at which the motor is supported leaves the container largely open-topped or uncovered.

A central shaft driven by the motor lies along an axis which is normal to the plane of the rim of the container. One end of the central shaft faces the container and is adapted to removeably retain a stirring piece disposed along the normal axis and leading into the container. The stirring piece is an elongated member with a central region shaped to slide along the normal axis to adjust the total length of the stirring piece and a bottom end shaped to stir the contents of the container. The stirring piece rotates with the turning of the motor driven shaft. In a preferred embodiment, the central region of the stirring piece comprises a telescopically adjustable shaft cooperating in a longitudinally sliding manner to allow the stirring piece to adapt or adjust to the depth of the container. Hence, the stirring device is self-adjustable to most any depth container.

The stirring piece may be permanently or removeably connected to the central shaft. In the latter case, other stirring pieces with similar removeably connecting ends and different shaped bottom ends may then be interchangeably used. Also a piece which serves as an extender with one end removeably connected to the central shaft and an opposite end adapted to removeably retain a stirring piece may be used.

The motor may be a spring wound or electrically operated motor. Further, the motor may drive the shaft and stirring piece at variable speeds. In one embodiment, the motor is spring wound and provides variable speed by two gears and a cone-shaped member positioned between the two gears. The cone-shaped member has numerous circular grooves about different circumferences of the cone shape. One gear has an edge positioned in one side of a groove and the second gear has an edge positioned in the same groove on an opposite side of the cone-shaped member. Such positioning of the two gears in different grooves defines different distances of separation between the two gears. The closer together the two gears are, the faster the gears drive the central shaft and stirring piece. The further apart the two gears are from each other, the slower the gears drive the central shaft and stirring piece. A user settable lever moves the cone-shaped member relative to the two gears to provide a change in common groove which in turn changes the distance of separation and thereby changes the speed of the device.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4*a* is a side view of a stirring assembly of the embodiment of FIG. 1.

FIG. 4*b* is a bottom view of an upper region of the stirring assembly of FIG. 4*a*.

FIGS. 5*a*–5*e* are schematic views of different stirring assemblies which can be interchangeably used with the embodiment of FIG. 1.

FIG. 6 is a schematic view of a battery operated embodiment of the present invention.

DETAILED DESCRIPTION OF THE PREFERRED EMBODIMENTS

Figure 1:
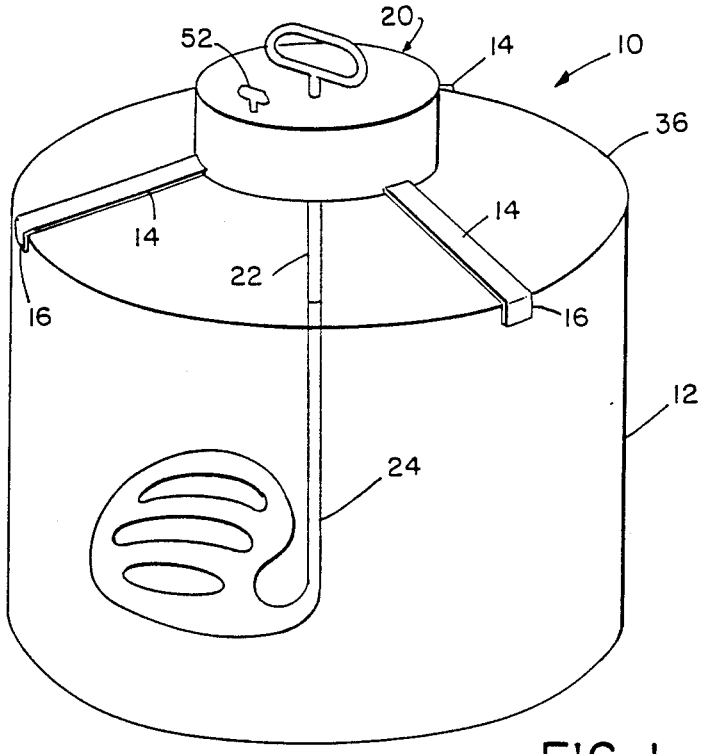
FIG. 1 is a schematic view of an embodiment of the present invention mounted on a container.

An automated stirring appliance embodying the present invention is schematically provided in FIG. 1. Stirring device 10 is mounted by three legs 14 onto a conventional cylindrical container 12 used generally for cooking over a burner or stove-stop source of heat. Stirring device 10 provides a motor 20 which drives shaft 22 centrally located with respect to container 12. Connected to central shaft 22 is stirring piece 24 which makes contact with the contents of container 12.

Figure 2:
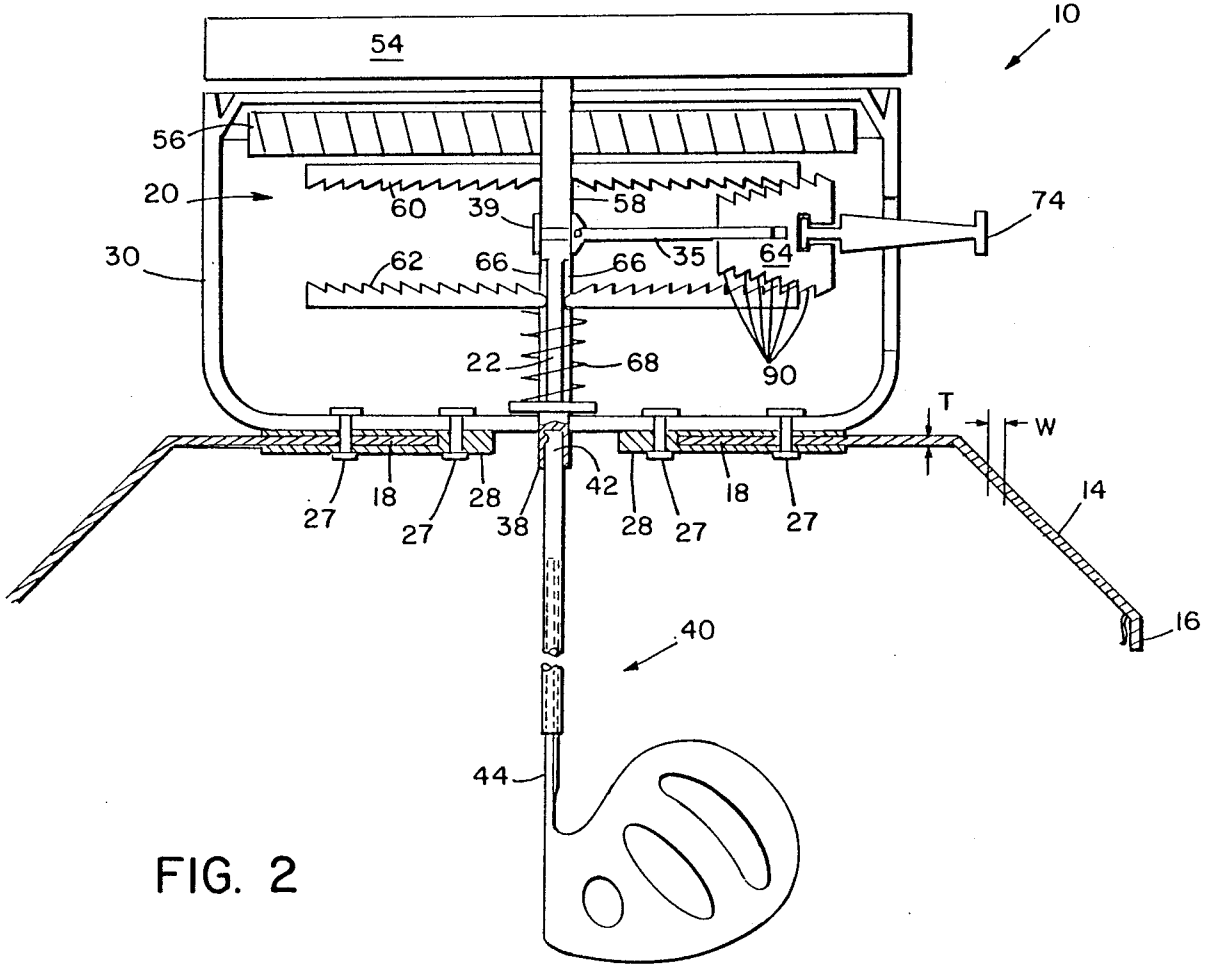
FIG. 2 is a partial longitudinal-section of the embodiment of FIG. 1 dismounted from the container.

As shown in more detail in FIG. 2, legs 14 each have an outer end 16 adapted to attach to the rim 36 of container 12. Outer end 16 is preferably u-shaped with legs that receive and embrace the rim 36 in a clip-on fashion. Opposite end 18 of each leg 14 slides telescopically within a respective sleeve 28 attached to a base region of motor housing to adjust the length of leg 14. Sleeves 28 have openings through which rivets 27 or the like are positioned and secure the sleeves to motor housing 30. The opposite end 18 of each leg 14 also has an opening in which a rivet 27 cooperates to allow the leg 14 to slide within sleeve 28 to the desired length. Between outer end 16 and opposite end 18 of each leg 14, the leg is bent or angled to provide maximum height above container 12. With the foregoing arrangement legs 14 extend to mount to containers 12 having diameters of about 7½ inches to about 11 inches.

Legs 14 are preferably stainless steel and have individual dimensions of about ⅝ inch wide(W), about ⅜ inch thick(T), and about 6½ inches in length from the outer most edge of opposite end 18 to outer end 16 as depicted in FIG. 2. The dimensions of the area within sleeves 28 are just slightly larger than the dimensions of the opposite ends 18 to cooperate with respective slideably adjustable legs 14.

Legs 14 support motor 20, jacketed by motor housing 30, above the plane in which the rim 36 of container 12 lies. The height at which legs 14 support motor 20 above rim 36 depends on the amount of extension of legs 14 needed to attach outer ends 16 to rim 36. However, at minimum, motor 20 is supported sufficiently above the plane in which rim 36 lies such that container 12 remains open-topped or uncovered by motor 20. Further, the width of legs 14 relative to the amount of space between pairs of legs about the circumference of rim 36 is substantially small such that legs 14 themselves do not effectively cover container 12.

Hence, it is understood that legs 14 may be of other dimensions and more numerous as long as their widths, separately or in combination or in combination with the height at which they support motor 20, are substantially less than the amount of open space left about rim 36. This preservation of the open-top/uncovered feature of container 12 is one object of the invention. The stirring of foods in the process of being cooked is very often accomplished with the container uncovered. The present invention thus simulates stirring with the container 12 uncovered. Further, some cooking techniques require the escape of steam or access to the food item (i.e. to add spices, etc.) during the cooking and stirring of the food item. The stirring device 10 of the present invention enables such escape of steam and access while providing automated stirring.

Figure 3:
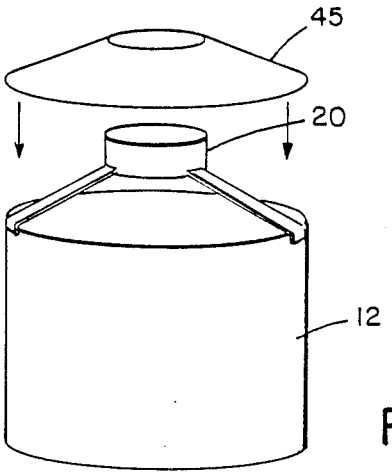
FIG. 3 is a schematic vie of the embodiment of FIG. 1 with a cover.

If it is desired to cover container 12, a cone shaped or hat-like piece 45 is mounted about motor 20 in a plane parallel to the plane of the rim of container 12 as shown in FIG. 3. Any user controls or switches of motor 20 protrude through a center opening in the hat-like piece 45. Hat-like piece 45 has at its widest end a diameter at least as large as that of container 12.

The actual disbursement of the contents of container 12 is accomplished through the rotation of central shaft 22 and connecting stirring assembly 40 shown in FIG. 2. Central shaft 22 is connected to motor 20 and lies along an axis which is normal to the plane of rim 36. Central shaft 22 leads downward toward a central area of container 12. End 38 of central shaft 22 faces container 12 and is adapted to removeably retain an upper region 42 of stirring assembly 40. A lower region 44 of stirring assembly 40 is shaped to disperse the contents of container 12. Upper region 42 and lower region 44 are connected to and cooperate with each other such that the length of assembly 40 self-adjusts to reach the bottom inner surface of container 12. When stirring assembly 40 is connected to central shaft 22, motor 20 drives central shaft 22 which in turn rotates stirring assembly 40 about the normal axis, and lower region 44 thereby stirs the contents of container 12.

Upper region 42 of stirring assembly 40 has a tip end 46 adapted to be removeably engaged with central shaft 22 as previously mentioned and shown in further detail in FIG. 4*a*. Opposite the tip end 46 of upper region 42 lies end 48 which is hollow to allow an upper portion of lower region 44 to slide telescopically therein. A bottom view of the upper region 42 at end 48 is provided in FIG. 4*b* where reference number 68 refers to a bore partially through upper region 42. A top portion of lower region 44 is shaped to engage in the hollow end 48 and to cooperate therewith in a longitudinal sliding manner along the normal axis. Such sliding enables the total length of stirring assembly 40 to be self-adjusted to the depth of container 12. The longitudinal sliding of lower region 44 relative to upper region 42 ceases when bottom end 50 of lower region 44 reaches the bottom inner surface of container 12.

In addition, the sliding connection between upper region 42 and lower region 44 does not affect the rotational movement of stirring assembly 40 about the normal axis. The shape of the bore 68 in upper region 42 and cooperating shape of lower region 44 fit sufficiently close such that regions 42 and 44 act as a uniform body when moving in the lateral and rotational direction. The shape of the bore 68 as shown in FIG. 4*b* is by way illustration of the foregoing feature and not limitation. Other shapes for the bore 68 and cooperating shapes of lower region 44 may be used.

Motor 20 may be of the spring wound or electrically operated type. In the case of the latter, motor 20 may include rechargeable batteries 98 or a conventional connection to an electrical outlet or the like as shown in FIG. 6. In addition, motor 20 may include gears or electronics for providing different speeds of rotation of the stirring assembly 40. A user settable switch 52 shown in FIG. 1 allows the user to control the speed of stirring assembly 40 and thereby the speed at which the contents of container 12 are dispersed.

An embodiment of the present invention having a spring wound variable speed motor is provided in FIG. 2. The user turns winder 54 to wind a flat coil spring 56. Flat coil spring 56 is attached to and drives a shaft 58 which in turn, through gears 60, 62, drives the central shaft 22 and rotates the stirring assembly 40. Shaft 58 passes through the center of and is connected to upper gear 60. A central shaft 22, lying along the same major axis as shaft 58, passes through the center of lower gear 62 which operates with the operation of upper gear 60. Upper gear 60 is fixedly connected to shaft 58 while edges of an aperture in the center of lower gear 62 are slideably retained in side grooves 66 in central shaft 22. A spring 68 is wrapped about central shaft 22 beneath lower gear 62 and supports lower gear 62 at various distances away from upper gear 60 as will be described. The two gears 60, 62 lie and operate in parallel planes which are perpendicular to the major axis of shafts 58 and 22.

Upper and lower gears 60, 62 separated by cone-shaped connector 64 determine the speed at which central shaft 22 is driven/rotated and the contents of the container are dispersed by the stirring assembly 40. Cone-shaped connector 64 has several circular grooves 90 about different circumferences of the cone shape. Due to the varying circumferences of the cone shape, each groove provides a different length path in which the gears 60, 62 operate. An edge of upper gear 60 is positioned in one groove 90 on one side of the cone-shaped connector 64 while an edge of lower gear 62 is positioned in the same groove 90 on an opposite side of the cone-shaped connector 64. Spring 68 holds lower gear 62 at the necessary height along shaft 22 such that the edge of lower gear 62 is so positioned in the same groove 90 as the upper gear 60. Flat coil spring 56, once wound, drives shaft 58 which in turn causes upper gear 60 to rotate about the major axis of respective shaft 58. This rotation of upper gear 60 is at one speed and causes cone-shaped connector 64 to rotate lower gear 62 at another speed. In turn, lower gear 62 rotates central shaft 22 which retains and rotates stirring assembly 40. Hence, the speed at which upper gear 60 turns lower gear 62, and thereby the speed at which stirring assembly 40 rotates, is regulated by the length of the groove of cone-shaped connector 64 in which the two gears 60, 62 are positioned.

It is understood that various dimensions of the cone shape may be used to provide various speeds of operation. In one embodiment, the cone shape has a series of four grooves of increasing lengths which provide operation speeds of 10 turns/minute, 20 turns/minute, 30 turns/minute and 40 turns/minute, respectively.

The user positions the two gears 60, 62 in a particular groove to effect a certain speed of operation of the device by speed switch 74. Speed switch 74 moves cone-shaped connector 64 closer or farther away from shaft 58 along an arm 35 disposed along an axis perpendicular to the major axis of shaft 58. The closer cone shape connector 64 is to shaft 58, the longer is the circular groove 90 in which upper and lower gears 60, 62 are positioned, and the slower is the speed of operation. The farther away the cone shape connector 64 is from shaft 58, the shorter is the groove in which the gears 60, 62 are positioned, and the faster is the speed of operation.

Arm 35 is supported on the shaft end by a cradle joint 39 which fits between the lower end of shaft 58 and upper end of shaft 22. Cradle joint 39 is adapted to hold the lower end of shaft 58 and the upper end of shaft 22 along the same major axis.

The speed of operation is one factor in providing the desired stirring motion of the device. In addition, the lower region 44 of stirring assembly 40 as shown in FIG. 3*b* may be of various shapes adapted to stir in different manners. Examples of other shapes of the lower region of the stirring assembly 40 are provided in FIGS. 5*a*–5*e*. The upper region 76 of each stirring assembly 40 is the same as upper region 42 described previously in FIG. 3*b*. Further, upper and lower regions 76, 78 of stirring assemblies 40 in FIGS. 5*a*–5*e* cooperate in a longitudinally sliding manner for self-adjustment to depth of the container as previously described in FIG. 4*a*.

Figure 5A:
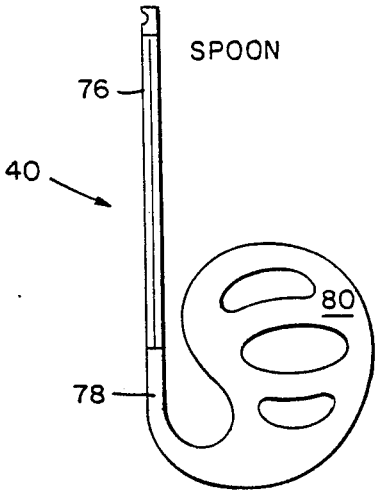
Figure 5B:
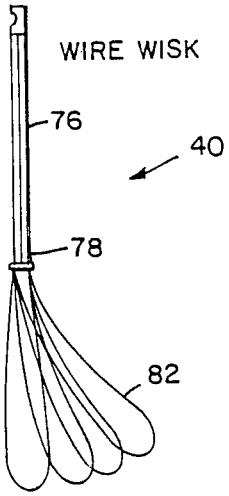
Figure 5C:
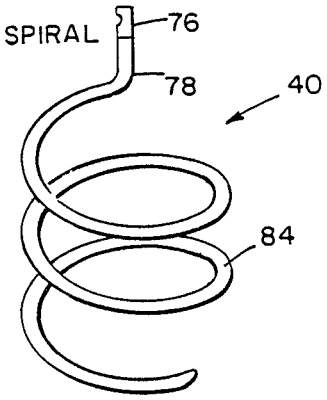
Figure 5D:
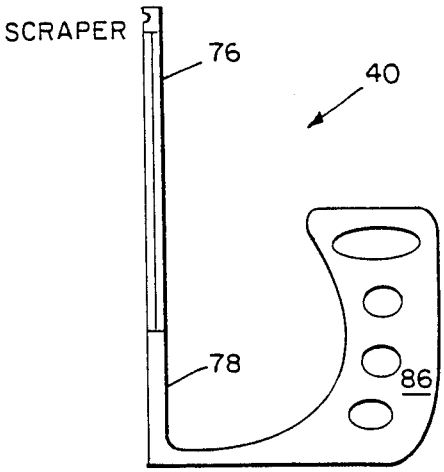

In FIG. 5*a*, lower region 78 has a bottom end 80 shaped like a slotted spoon. In FIG. 5*b*, lower region 78 has a bottom end 82 shaped like a wire whisk for allowing air to be mixed into the contents during stirring. In FIG. 5*c*, the bottom end 84 of lower region 78 is a spiral wire for stirring relatively heavy or thick contents of the container. In FIG. 5*d*, the bottom end 86 provides a flat bottom edge and a side edge for scraping the inner bottom and side walls respectively of the container. In FIG. 5*e*, the bottom end 88 is a series of metallic (i.e. aluminum) rectangular pieces linked end to end in a chain-like fashion. During stirring, the chain-linked pieces move in a snake-like manner to provide a type of light and quick stirring or tumbling of the contents of the container. Such stirring is useful for stir-frying in a cooking container such as a wok.

It is understood that other shapes may be used and that some shapes may be more effective at certain speeds.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. A stirring device for stirring contents of an open-top container comprising:

a motor;

a shaft longitudinally disposed along an axis normal to the plane in which the open-top of the container lies, the shaft having one end connected to the motor and an opposite end directed toward the container, the motor driving the shaft rotationally about the normal axis;

a plurality of legs each having one end attached about different sides of the motor and an opposite end adapted to mount onto the container, the legs supporting the motor, above the plane in which the open-top of the container, lies in such a manner that the open-top of the container remains substantially uncovered by the motor and legs; and an elongate member having an upper and lower region, one end of the upper region connected to the end of the shaft, an opposite end of the upper region shaped to cooperate with a top end of the lower region in a sliding manner along the normal axis such that the elongate member self-adjusts to a depth of the container, and a bottom end of the lower region adapted to stir the contents of the container, the bottom end being adjacent to a lower inner surface of the container;

the elongate member being rotated about the normal axis by the motor driven shaft and thus, stirring the contents of the container.

2. A stirring device as claimed in claim 1 wherein the motor is spring driven.

3. A stirring device as claimed in claim 2 wherein the motor is a variable speed motor comprising:

two working gears positioned in parallel planes each having respective centers lying along the normal axis, the shaft passing through and connected to the center of one gear and adapted to support the second gear at various distances away from the one gear, the one gear rotating the second gear through the distance between the two working gears, the distance defining a speed of rotation of the elongate member;

a cone shaped member having a plurality of circular shaped grooves about different circumferences of the cone shape, one end of one gear removeably positioned in one groove on one side of the cone shape and one end of the second gear removeably positioned in the same groove on an opposite side of the cone shape, the positioning of the respective one ends of the two working gears in the same groove on opposite sides of the cone shape defining the distance between the two working gears and thus a speed of the motor; and means for adjusting the position of the cone-shaped member, such that the respective one ends of the two working gears lie in another groove to provide a different distance between the two working gears and thus a different speed of the motor.

4. A stirring device as claimed in claim 1 wherein the motor is electrically powered.

5. A stirring device as claimed in claim 4 wherein the motor drives the shaft at different user selected speeds.

6. A stirring device as claimed in claim 5 wherein the motor includes batteries.

7. A stirring device as claimed in claim 6 wherein the batteries are rechargeable.

8. A stirring device as claimed in claim 1 wherein the one end of the upper region of the elongate member removably connects to the opposite end of the shaft.

9. A stirring device as claimed in claim 8 further comprising a plurality of interchangeable elongate members each having one end of an upper region removably connected to the opposite end of the shaft and a different shaped bottom end of a lower region for stirring the contents of the container in different manners.

10. A stirring device as claimed in claim 9 wherein one of said elongate members has a bottom end of a lower region comprising a multiplicity of pieces each shaped about the same, linked together in a chain-like fashion so as to enable the bottom end to move in a snake-like manner to lightly disperse the contents of the container.

11. An improved stirring device of the type having a motor and adapted to be mounted to a container for stirring the contents of the container, the improvement comprising:

a central shaft driven by the motor having one end connected to the motor and an opposite end directed toward the container;

a plurality of legs each having one end connected to the motor and an opposite end adapted to be mounted to the container, the legs being narrow enough relative to space between pairs of the legs positioned about the container and extending above the container enough to support the motor at a height above the container such that the container is substantially uncovered by the legs and motor; and an elongated member of variable length one end removably connected to the opposite end of the central shaft, a lower end opposite the one end adapted to stir the contents of the container, and a middle region between the one end and the lower end of the elongated member, the middle region being adapted to longitudinally slide along a major axis of the elongated member such that the length of the elongated member self adjusts to a depth of the container and is maintained as the elongated member rotates within the container to stir the contents.

12. A stirring device as claimed in claim 11 wherein the elongated member has a lower end comprising a multiplicity of similarly shaped pieces, linked together in a chain-like fashion so as to move in a snake-like manner when the elongated member is rotated within the container to lightly stir the contents.

13. A method of stirring the contents of a container comprising:

providing a stirring device having a shaft along an axis normal to a plane of a rim of the container, the shaft driven by a motor, and a plurality of legs supporting the motor above the plane of the rim of the container in such a manner that the container is left open-topped; and connecting one end of a stirring utensil to the shaft driven by the motor, the stirring utensil lying along the normal axis, the stirring utensil having a middle region which slides along the normal axis in a telescoping manner such that the stirring utensil self adjusts to a depth of the container and an end opposite the one end of the utensil disperses the contents of the container.

* * * * *